US009725937B2

(12) United States Patent
Lange et al.

(10) Patent No.: US 9,725,937 B2
(45) Date of Patent: Aug. 8, 2017

(54) MATTRESS STRUCTURE AND HINGE MECHANISM

(71) Applicant: KIDS II, INC., Atlanta, GA (US)

(72) Inventors: Eric A. Lange, Alpharetta, GA (US); Sean Zou, Heyuan (CN); Simon Liao, Wuhan (CN)

(73) Assignee: KIDS II, INC., Atlanta, GA (US)

( * ) Notice: Subject to any disclaimer, the term of this patent is extended or adjusted under 35 U.S.C. 154(b) by 203 days.

(21) Appl. No.: 14/307,124

(22) Filed: Jun. 17, 2014

(65) Prior Publication Data

US 2014/0373283 A1 Dec. 25, 2014

Related U.S. Application Data

(60) Provisional application No. 61/836,869, filed on Jun. 19, 2013.

(51) Int. Cl.

| | |
|---|---|
| ***A47C 17/00*** | (2006.01) |
| ***E05D 3/00*** | (2006.01) |
| ***A47D 15/00*** | (2006.01) |
| ***E05D 1/02*** | (2006.01) |

(52) U.S. Cl.

CPC ..... *E05D 3/00* (2013.01); *A47D 15/003* (2013.01); *E05D 1/02* (2013.01); *Y10T 16/52* (2015.01)

(58) Field of Classification Search

CPC ..... A47C 27/00
USPC ..... 5/722, 655, 657, 640; 16/350, 363
See application file for complete search history.

(56) References Cited

U.S. PATENT DOCUMENTS

| | | | | |
|---|---|---|---|---|
| 3,210,808 | A * | 10/1965 | Creager | E04B 1/0046 16/225 |
| 4,921,369 | A | 5/1990 | Chew, II et al. | |
| 5,349,709 | A | 9/1994 | Cheng | |
| 5,473,785 | A | 12/1995 | Lager et al. | |
| 5,555,577 | A | 9/1996 | Volpe | |
| 5,845,349 | A | 12/1998 | Tharalson et al. | |
| 6,148,456 | A | 11/2000 | Tharalson et al. | |
| 6,233,759 | B1 | 5/2001 | Warner, Jr. et al. | |
| 6,301,731 | B1 | 10/2001 | Jakubowski et al. | |
| 6,434,767 | B1 | 8/2002 | Welsh, Jr. | |
| 6,510,570 | B2 | 1/2003 | Hartenstine et al. | |
| 6,560,795 | B2 | 5/2003 | Hsia | |
| 6,574,812 | B2 | 6/2003 | Jakubowski et al. | |
| 6,578,211 | B2 | 6/2003 | Tharalson et al. | |
| 6,877,173 | B2 | 4/2005 | Tharalson et al. | |
| 6,901,613 | B1 | 6/2005 | Hsia | |
| 6,931,677 | B2 | 8/2005 | Tharalson et al. | |
| 7,003,821 | B2 | 2/2006 | DeHart et al. | |
| 7,013,505 | B2 | 3/2006 | Martin | |
| 7,017,203 | B2 | 3/2006 | Chen | |
| RE39,136 | E | 6/2006 | Tharalson et al. | |
| 7,404,219 | B2 | 7/2008 | Berkey | |
| 7,415,739 | B2 | 8/2008 | Tharalson et al. | |
| 7,543,342 | B2 | 6/2009 | Zhao et al. | |

(Continued)

*Primary Examiner* — Fredrick Conley
(74) *Attorney, Agent, or Firm* — Gardner Groff Greenwald & Villanueva, PC

(57) ABSTRACT

A hinge mechanism and mattress for use with a child containment device. A first mattress panel is pivotally coupled to a second mattress panel by a hinge mechanism, and is thereby convertible between an expanded configuration and a collapsed configuration. The hinge mechanism defines a limit point beyond which pivotal motion is prevented in at least one direction.

11 Claims, 7 Drawing Sheets

(56) References Cited

U.S. PATENT DOCUMENTS

| | | | |
|---|---|---|---|
| 7,739,759 | B2 | 6/2010 | Mendes et al. |
| 7,752,693 | B2 | 7/2010 | Espenshade |
| 7,882,579 | B2 | 2/2011 | Jackson et al. |
| 8,141,186 | B2 | 3/2012 | Burns et al. |
| 8,201,291 | B2 | 6/2012 | Burns et al. |
| 8,424,131 | B2 | 4/2013 | Thomsen et al. |
| 8,528,130 | B2 | 9/2013 | Bu et al. |
| 8,566,988 | B2 | 10/2013 | Son et al. |
| 2006/0000019 | A1 | 1/2006 | Martin |
| 2007/0271697 | A1 | 11/2007 | Martin |
| 2009/0077742 | A1 | 3/2009 | Burns et al. |
| 2012/0216346 | A1 | 8/2012 | Rampton et al. |
| 2012/0233770 | A1 | 9/2012 | Greger et al. |

* cited by examiner

MATTRESS STRUCTURE AND HINGE MECHANISM

CROSS-REFERENCE TO RELATED APPLICATIONS

This application claims the benefit of U.S. Provisional Patent Application Ser. No. 61/836,869 filed Jun. 19, 2013, the entirety of which is hereby incorporated herein by reference for all purposes.

TECHNICAL FIELD

The present invention relates generally to the field of child sleeping or containment devices, and more particularly to a mattress and a hinge for a child sleeping or containment device such as a portable crib, sleeper or play-yard.

BACKGROUND

Children's and infant's sleeping and containment devices such as portable cribs, sleepers and play-yards are typically lightweight and portable. Some containment devices are generally utilized for providing an area where a child or infant can comfortably lay, sleep or rest. Typically, a sleeping platform or mattress is provided to fit within the containment device to provide support and comfort the child or infant. It is generally desirable to maintain a flat sleeping surface in children's sleep products, for comfort and safety of the child, as well as compliance with industry standards and/or regulation. The provision of sufficient structure and support to maintain the desired flat sleeping surface configuration in known mattresses and sleeping platforms for such devices commonly results in products that are bulky, heavy, and lacking convenience in portability.

Continuing improvement child sleeping, containment and other devices is sought. It is to the provision of an improved mattress structure and improved hinge mechanism meeting these and other needs that the present invention is primarily directed.

SUMMARY

In example embodiments, the present invention provides a mattress structure having panels with at least one hinge therebetween for providing pivotal movement of the panels of the mattress structure between a collapsed configuration and an expanded configuration.

In one aspect, the present invention relates to a hinge, the hinge preferably including a first mounting portion, a second mounting portion positioned generally opposite the first mounting portion, and at least one flexible member extending between the first and second mounting portions to pivotally couple the first mounting portion to the second mounting portion. The hinge preferably further includes at least one tooth extending transversely from the at least one flexible member for interengagement between the first and second mounting portions to define a limit beyond which further pivotal motion of the first mounting portion relative to the second mounting portion in at least one direction is restricted.

In another aspect, the present invention relates to a hinged panel assembly. The hinged panel assembly preferably includes a first panel, a second panel, and at least one hinge pivotally coupling the first panel and the second panel to allow relative pivotal motion therebetween. The hinge preferably includes a first mounting portion for attachment to the first panel, a second mounting portion opposite the first mounting portion for attachment to the second panel, at least one flexible member extending between the first and second mounting portions, and at least one tooth extending from the at least one flexible member for interengagement between the first and second mounting portions to define a limit beyond which the pivotal motion of the panels is restricted.

In another aspect, the present invention relates to a mattress for use with a child containment device. The mattress preferably includes a first mattress panel and a second mattress panel pivotally coupled to the first mattress panel. The mattress is preferably convertible between an expanded configuration and a collapsed configuration. The mattress preferably includes a mattress pad in combination with the first and second mattress panels, and the second mattress panel is preferably pivotally coupled to the first mattress panel by a hinge mechanism.

In still another aspect, the present invention relates to a method for controlling pivotal movement of a first member relative to a second member. The method preferably includes providing at least one hinge between the first member and the second member, pivoting the first member relative to the second member into a collapsed configuration by disengagement of a series of interengagement members of the at least one hinge, and pivoting the first member relative to the second member into an expanded configuration by engagement of the series of interengagement members of the at least one hinge into abutment with one another to restrict pivotal motion beyond the expanded configuration.

In another aspect, the present invention relates to a mattress or sleeping platform for use with a child containment device including a first mattress panel, a second mattress panel hingedly coupled to the first mattress panel and configured for pivotal movement relative to the first mattress panel, and a mattress pad for receiving and containing the first and second pivotally-coupled mattress panels. Preferably, the mattress is convertible between an expanded configuration and a collapsed configuration. In example forms, the mattress includes a hinge mechanism for pivotally coupling the first mattress panel to the second mattress panel. In one form, the hinge mechanism comprises a first mounting portion and a second mounting portion joined together by at least one flexible spine. The at least one flexible spine has at least one tab extending therefrom for interengagement with portions of the first and second mounting portions. Preferably, the first mounting portion comprises a recessed portion for interengaging with a rib extending from a first side of the at least one tab and a wherein the second mounting portion comprises a rib for interengaging a recessed portion extending from a second side of the at least one tab. In example forms, the recessed portion and the rib of the tab are configured to engage with the respective rib and recessed portions of the first and second mounting portions in the expanded configuration and to disengage each other in the collapsed configuration.

In another aspect, the invention relates to a hinge for use with two or more panel members, the hinge including a first mounting portion, a second mounting portion, at least one flexible member, and at least one tooth. The first and second mounting portions are generally positioned opposite one another, each having at least one opening for receiving a fastener such that the first mounting portion is configured for coupling to a first panel member and the second mounting portion is configured for coupling to a second panel member. The at least one flexible member extends between and interconnects the first and second mounting portions together. The at least one tooth extends transversely from the at least one flexible member for interengagement with portions of the first and second mounting portions. Preferably, the panels can pivot relative to one another between a collapsed configuration and an expanded configuration such that the at least one tooth is interengaged between the first and second mounting portions when the panels are in the expanded position to fix the panels in the expanded configuration and prevent further pivotal movement in one direction but allow pivotal movement in the other direction to return the panels to the collapsed configuration.

In still another aspect, the invention relates to a hinge including a first mounting portion, a second mounting portion positioned generally opposite the first mounting portion, at least one flexible member joining the first and second mounting portions together, and at least one tooth extending from the at least one flexible member for interengagement with portions of the first and second mounting portions. In example forms, the first and second mounting portions, the at least one flexible member, and the at least one tooth are integrally formed together. In one form, at least three generally parallel flexible members join the first and second mounting portions together and at least two of the flexible members have at least one tooth extending therefrom. The at least one tooth includes interengagement features for cooperatively engaging portions of the first and second mounting portions. In some forms, the first mounting portion has a recessed portion for interengaging a rib extending from the at least one tooth and the second mounting portion has a rib for interengaging a recessed portion of the tooth.

In yet another aspect, the present invention relates to a method for restricting or controlling the pivotal movement of a first member relative to a second member including providing a hinge member, the hinge member including first and second mounting portions joined together by at least one flexible member, the first and second mounting portions having a top side and bottom side, the flexible member having at least one rib extending therefrom for interengaging with portions of the first and second mounting portions; coupling the bottom side of one of the first and second mounting portions to one of the first and second members; coupling the bottom side of the other of the first and second mounting portions to the other of the first and second members, the first and second members generally being positioned by each other in a first horizontal plane; and pivoting the first member relative to the second member, wherein the pivotal motion of the first member in a first direction allows the at least one flexible member to flex such that the first member is generally positioned adjacent the second member in a second plane that is generally parallel and offset from the first plane, and wherein the pivotal motion of the first member in a second direction is restricted by the engagement of the at least one tab with the portions of the first and second mounting portions to limit the angular offset between the first and second members in one direction.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
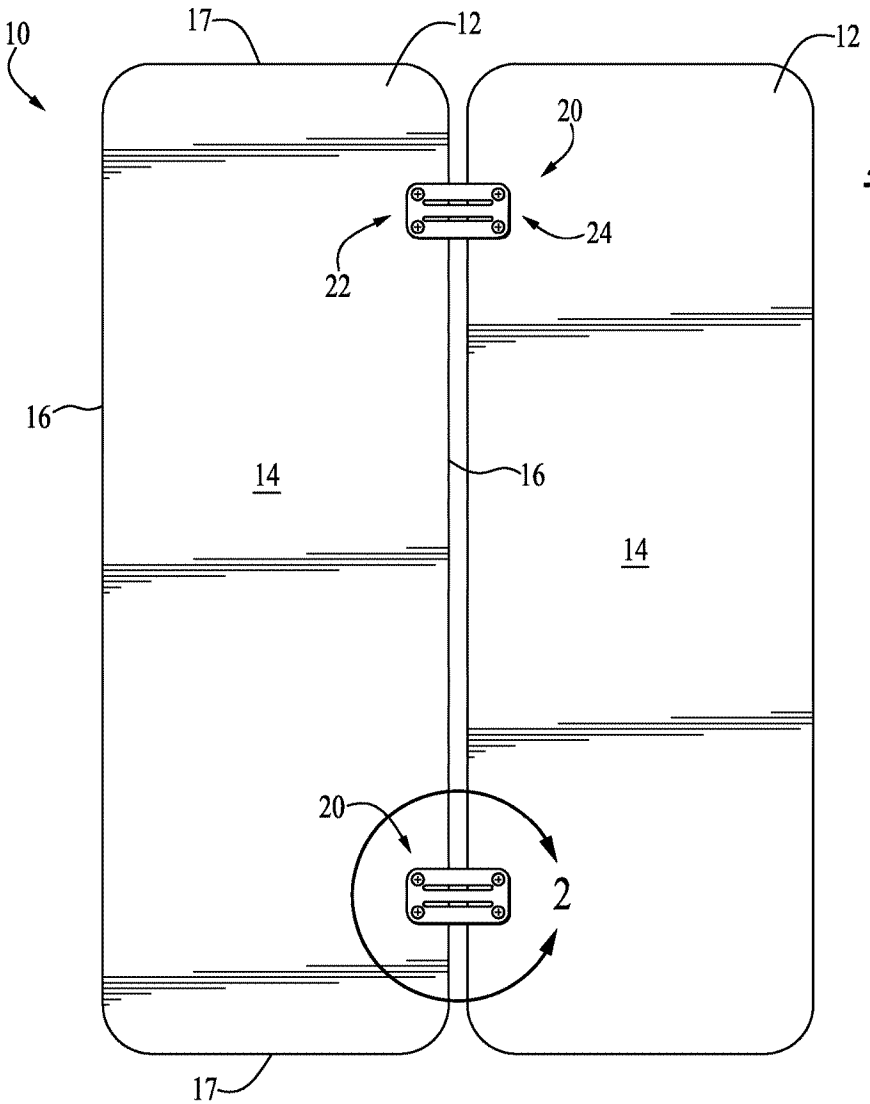
FIG. 1 is a bottom view of a mattress structure in an expanded configuration according to an example embodiment of the present invention.

With reference now to the drawing figures, wherein like reference numbers represent corresponding parts throughout the several views, FIG. 1 shows a mattress structure or support platform 10 for positioning in a crib, sleeper, playyard, child containment device or other structure and supporting a child placed therein or thereon. Optionally, the mattress structure or platform 10 can be configured for use with other juvenile products or other products incorporating a structural platform. The mattress structure 10 generally comprises one or more panels 12 pivotally or hingedly coupled to one another by one or more hinges 20. As depicted in FIG. 1, the mattress structure 10 comprises two substantially rigid panels 12 that are pivotally coupled together by two hinges 20. In one example form, the hinges 20 are one-directional limiting, such that the panels can pivot relative to each other between an expanded or generally planar configuration and a collapsed or folded configuration, but pivotal movement from the collapsed configuration to the expanded configuration is limited to restrict further pivotal movement beyond the expanded configuration. Optionally, more or less than two hinges 20 may be provided for pivotally coupling the two panels 12 together.

The panels 12 are generally rigid or substantially rigid and each comprise a generally planar rectangular surface 14 having opposing sides 16 and opposing ends 17. In one example form, the edges of the sides and ends 16, 17 and the corners adjoining the sides and ends 16, 17 are radiused to provide smooth transitions between the surfaces and avoid sharp edges and corners. Typically, the panels 12 are coupled along adjacent confronting sides 16 thereof, by the hinges 20 which attach between the panels. With the hinges 20 pivotally coupling the two panels 12 together, the panels can pivot relative to each other such that the mattress structure 10 is convertible between the expanded configuration for use as a support platform and the collapsed configuration for more compact storage or transport. In the expanded configuration, as shown in FIG. 1, the panels 12 are aligned side-by-side and co-planar in a substantially horizontal plane to create a generally flat surface for supporting the child. In example forms, the confronting sides 16 of the first and second panels 12 are spaced a distance apart with the sides generally parallel with each other in the expanded configuration, such that an elongate channel is defined between the sides 16. In other example forms, the confronting sides 16 of the panels are substantially adjacent and abutting one another such that the side edges 16 are generally in contact with one other in the expanded configuration. The panels 12 can be formed from various materials including plastics (e.g., polypropylene, acrylonitrile butadiene styrene (ABS)), wood (e.g., medium-density fiberboard (MDF), plywood), composites, or other materials as desired.

In one example form, the hinges 20 are generally rectangular in shape and extend from a first end 22 to a second end 24. Typically, the hinges 20 are in the form of a living-style hinge. The first end 22 comprises a first mounting portion 30 and the second end 24 comprises a second mounting portion 32. Generally, the first and second mounting portions 30, 32 are offset from each other at opposite ends of the hinge, and joined together by at least one spine or flexible member 40. Typically, the first and second mounting portions comprise at least one opening 34 for receiving fasteners 36 to couple the mounting portions 30, 32 to the panels 12. In one example form, four openings 34 are provided for receiving four fasteners 36, two on each side. The fasteners 36 can be screws, nails, bolts, rivets, staples, interengaging members, clamps, interlocking features, and other coupling members as desired. Alternatively the hinges 20 can be integrally formed with the panels 12, or attached by adhesive, welding or other attachment means. Typically, a bottom side or surface of the first and second mounting portions 30, 32 are in contact with the panels 12 when coupled thereto, and a top side or surface thereof is positioned generally opposite the bottom side and in contact with a head portion of the fasteners 36.

Figure 2:
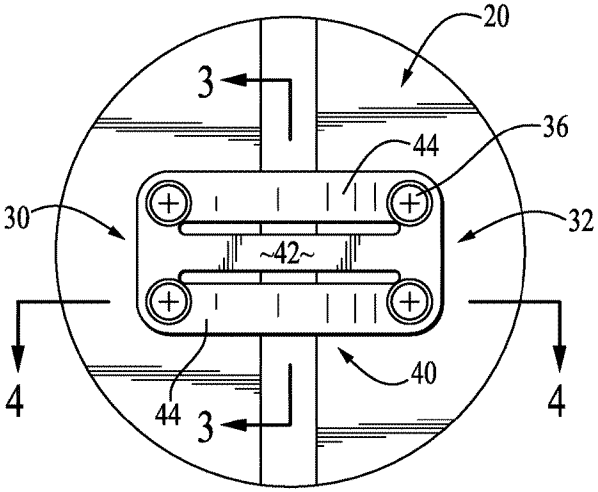
FIG. 2 is a detailed view of a hinge mechanism of the mattress structure of FIG. 1.
Figure 3:
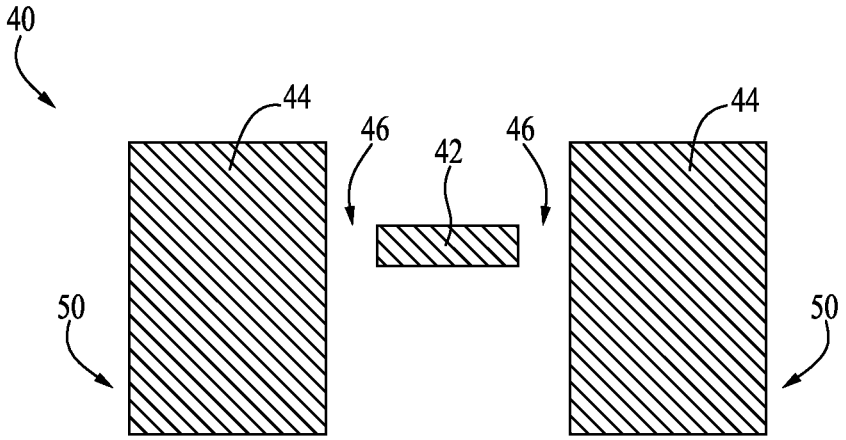
FIG. 3 is a cross-sectional view of the hinge mechanism of FIG. 2 taken along lines 3-3.

As depicted in FIGS. 2-3, the first and second mounting portions 30, 32 are joined together by a one or more flexible members 40, for example a central flexible member 42 and a pair of outer flexible members 44. In example forms, a channel 46 is defined along either side of the central flexible member 42 such that the outer flexible members 44 are generally spaced apart and independently flexible from the central flexible member 42. The hinges 20 can be formed from a variety of durable, flexible materials, including but not limited to, polypropylene, nylon, rubber, PCR-thermoplastic, or other materials as desired. Preferably, the material allows for flexibility of the flexible members 40 without yielding, stress-cracking or permanent deformation from repeated flexure cycles. In some forms, the material has a substantially high yield strength and can undergo elastic deformation.

Figure 4:
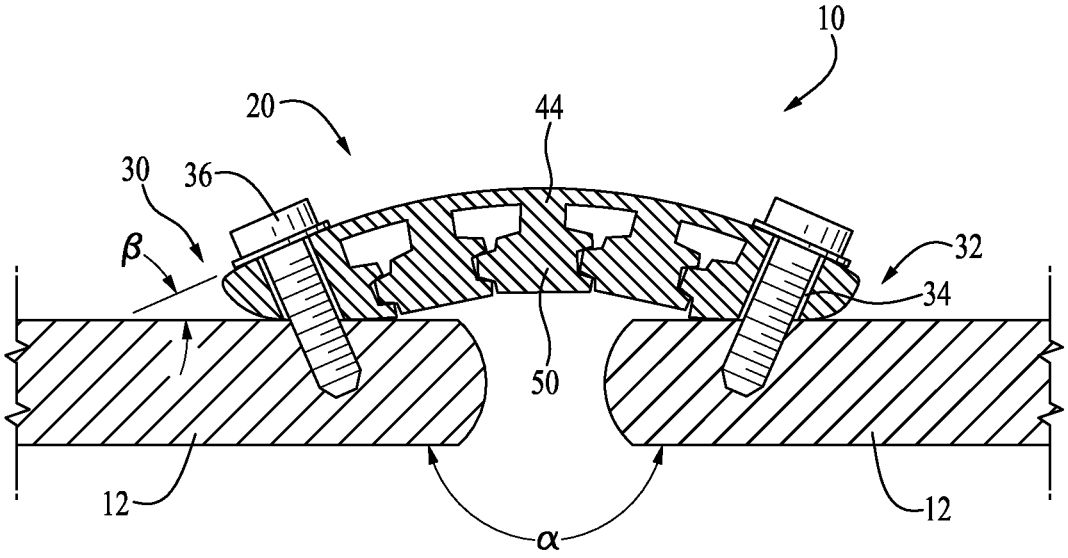
FIG. 4 is a cross-sectional view of the hinge mechanism of FIG. 2 taken along lines 4-4.

As depicted in FIG. 4, at least one of the outer flexible members 44 comprises a plurality of tabs or teeth 50 extending generally transversely or perpendicularly therefrom for interengaging with portions of the first and second mounting portions 30, 32 when the mattress structure 10 is in the expanded configuration. Preferably, each of the outer flexible members 44 comprises a plurality of teeth 50 extending therefrom, forming a parallel spaced-apart pair of arrays of teeth 50, with the central flexible member 42 extending therebetween. In example embodiments, the plurality of teeth 50 interengage with one another and with portions of the first and second mounting portions 30, 32 such that the pivotal movement between the panels 12 is restricted to about 180°, or within about 160°-200° with respect to one another. For example, FIGS. 5-8 show the panels 12 of the mattress structure 10 being pivoted relative to one another between the expanded configuration and the collapsed configuration. Thus, the hinges 20 are one-directional such that the at least one flexible member and the teeth extending therefrom allow pivotal motion of the panels 12 relative to one another in a first direction but prevent pivotal motion thereof beyond a limit point at the expanded configuration in a second direction that is generally opposite the first direction.

Figure 5:
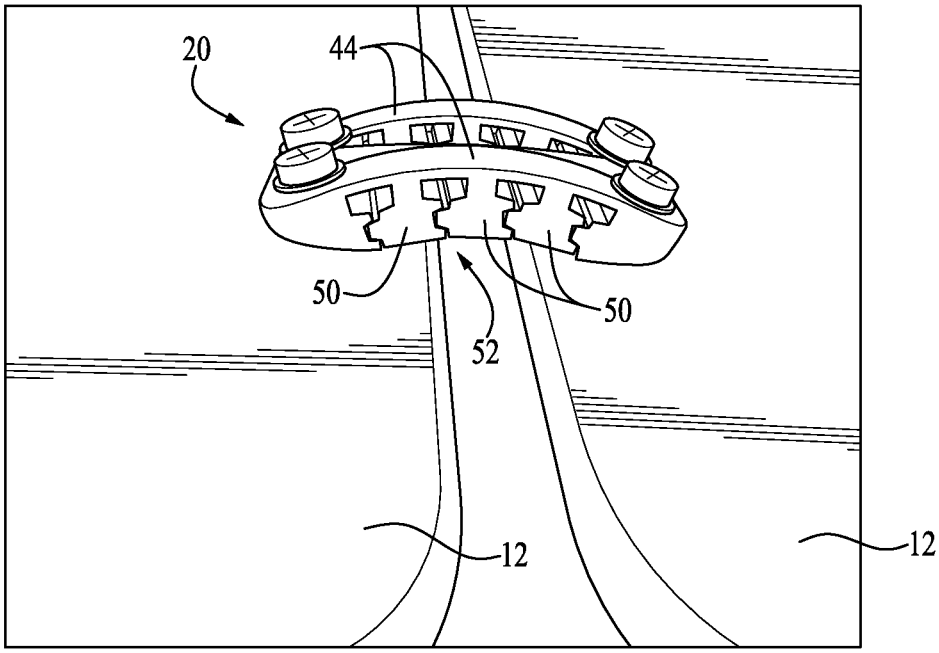
FIG. 5 is a perspective view of a hinge mechanism of the mattress structure of FIG. 1, in an expanded or locked/engaged configuration.
Figure 6:
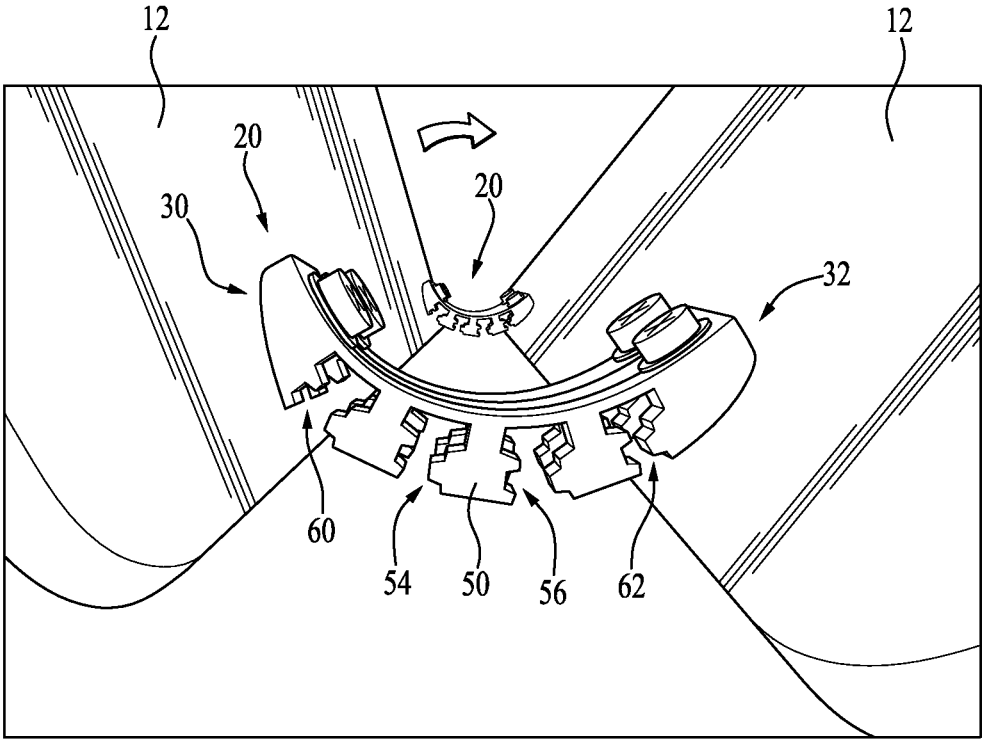
FIG. 6 is a side perspective view of the hinge mechanism of FIG. 1, in a semi-collapsed, unlocked/disengaged configuration.
Figure 7:
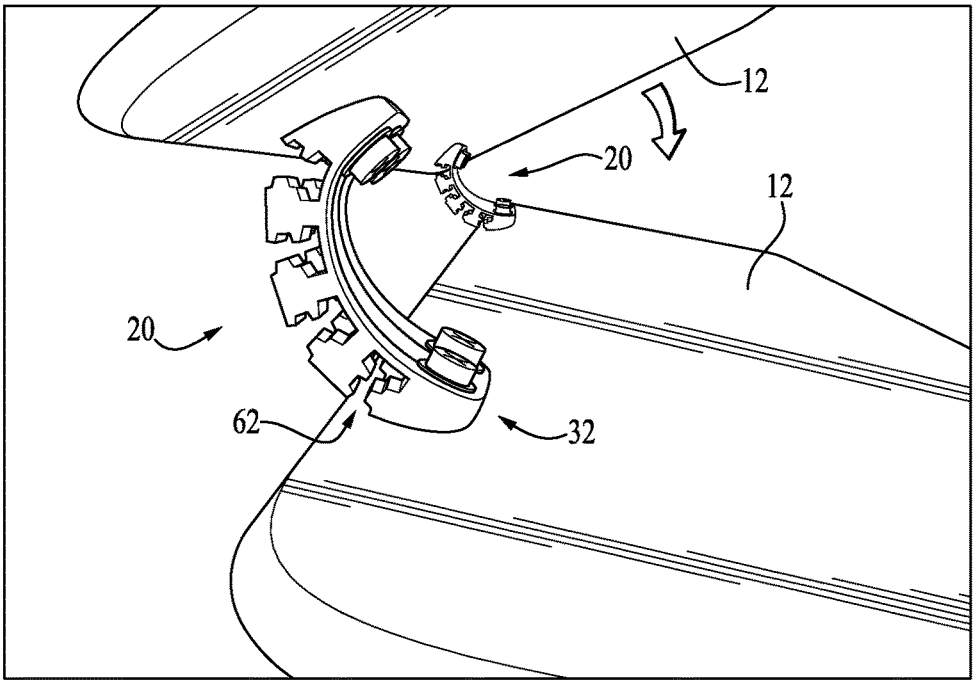
FIG. 7 is a side perspective view of the hinge mechanism of FIG. 6.
Figure 8:
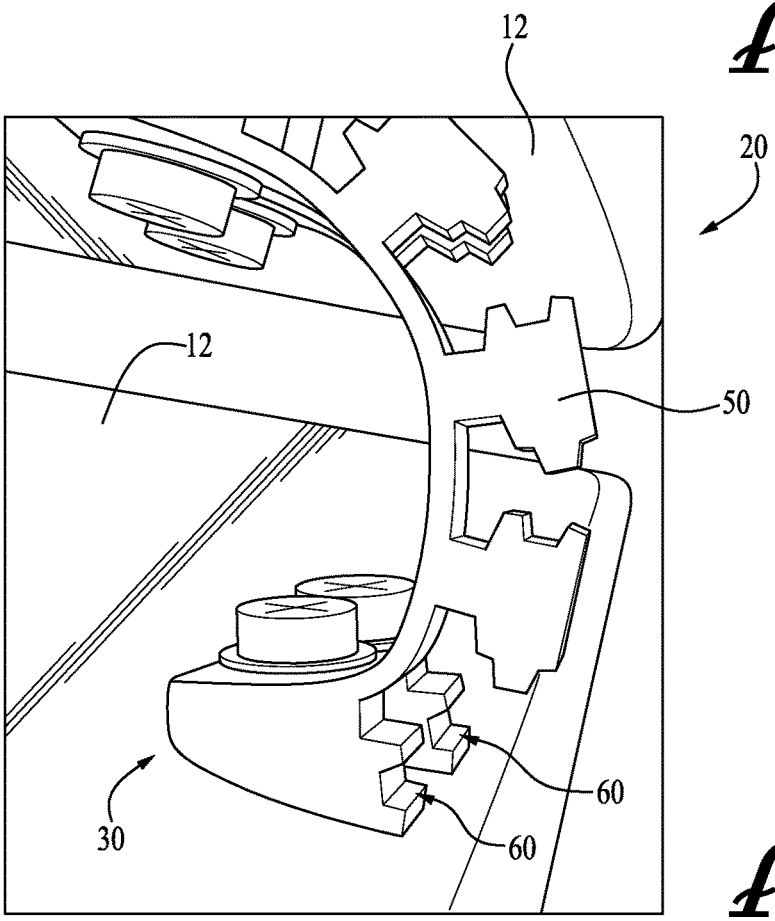
FIG. 8 is a side perspective view of the hinge mechanism of FIG. 6, showing the mattress structure in a fully collapsed configuration.

FIG. 5 shows the expanded configuration of the panels 12 with the teeth 50 of the hinge 20 interengaging one other to define the limit point beyond which movement is restricted by engagement or locking of the teeth 50 in a continuous abutting array between the first and second mounting portions 30, 32. In the depicted embodiment, the limit point of the hinges 20 coincides with an expanded configuration of the panels 12 being aligned side-by-side in a substantially horizontal and co-planarly aligned position (i.e., about 180° pivot angle $\alpha$, as shown in FIG. 4). In alternate embodiments, the limit point of the hinges can be set at any desired pivot angle between the panels, by varying the size, spacing, number and/or configuration of the teeth 50 and the first and second mounting portions 30, 32. Preferably, the teeth 50 comprise mating interengagement features 52 for cooperatively interengaging with adjacent teeth 50 and with interior tooth-engagement features of the first and second mounting portions 30, 32. As shown in FIG. 6, as one of the panels 12 begins to pivot in the first direction (from the expanded configuration toward the collapsed configuration) relative to the other panel (see direction arrow), the teeth 50 become disengaged from each other and interior tooth-engagement features the of the first and second mounting portions 30, 32 such that the flexible members 40 can freely flex and allow the panels to be folded relative to each other such that one of the panels 12 is generally positioned atop the other panel 12 (e.g., folded, at a 0° or 360° pivot angle) in the collapsed configuration (see FIG. 8).

As shown in FIG. 6, the interengagement features 52 of the tooth 50 generally comprise a rib 54 extending along one side thereof and a recess or channel 56 formed along an opposite side thereof. Preferably, the first mounting portion 30 comprises a correspondingly shaped recessed portion or channel 60 formed along in inner side thereof and the second mounting portion 32 comprises a correspondingly shaped rib 62 extending along an inner side thereof. Typically, the rib 54 and recess 56 of the teeth 50 are generally oriented and positioned such that when the first and second mounting portions 30, 32 are generally facing each other and positioned along a substantially similar plane, the recess 60 of the first mounting portion 30 is interengaged with the rib 54 of one of the teeth 50, and the rib 62 of the second mounting portion is interengaged with the recess 50 of one of the teeth 50, and corresponding intermediate ribs and recesses of adjacent teeth 50 are engaged. Thus, interengagement of the teeth 50 and the first and second mounting portions 30, 32 restrict the hinge 20 from pivoting in the second direction (i.e., from the collapsed configuration toward the expanded configuration) beyond the limit point. In example forms, a pivot angle α defined between the two panels 12 at the limit point or hinge locking position is generally about 160°-200°, preferably about 180° (see FIG. 4). In alternate forms, the limit point or hinge locking position may be engaged at pivot angles of 30°, 45°, 60°, 90°, 120°, 150°, or at other angles as desired for a particular application.

In the depicted embodiment, three teeth 50 are provided on each of the outer flexible members 44, which are sized and shaped to provide the outer flexible members 44 with an arc-like shape that generally extends above the central flexible member 42 in the expanded configuration. In this manner, an arch structure is defined (see FIG. 4) by the engaged array of teeth 50 in the expanded configuration, for improved load-bearing properties. Furthermore, the first and second mounting portions 30, 32 can be wedge-shaped or inclined to further define the arched profile of the outer flexible members 44 and position fasteners 36 at an oblique inwardly directed angle relative to the panels 12 for increased holding strength. In example embodiments, the first and second mounting portions 30, 32 define an angle β relative to the panel 12 that is generally between about 15°-60°. In one example form, the first and second mounting portions 30, 32 are shaped at the angle β to assist the panels 12 in remaining in the expanded configuration (e.g., side-by-side in a substantially horizontal plane). In the expanded configuration (FIG. 4), the arrays of teeth 50 are transversely offset inwardly a distance toward the panels 12 from the outer flexible members 44 of the hinge 20, and are maintained in compression with the teeth 50 abutting one another to prevent further pivotal movement beyond the limit point; while the outer flexible members 44 and/or the central flexible member 42 are in tension to prevent disengagement of the teeth 50 from one another.

Figure 9:
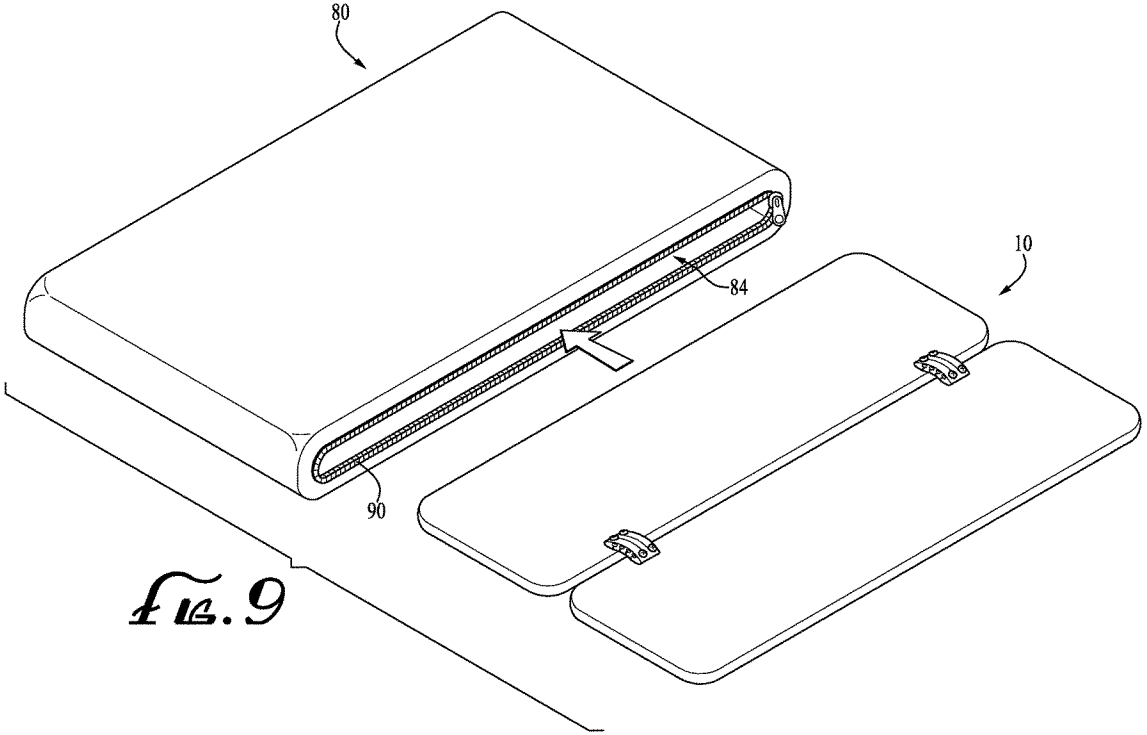
FIG. 9 is a perspective view of the mattress structure of FIG. 1 being inserted within a mattress pad to form a mattress assembly according to an example embodiment of the present invention.

As depicted in FIG. 9, the mattress platform 10 is optionally configured to fit within a mattress pad or sleeve 80 in its expanded configuration to form a mattress assembly. The mattress pad 80 is preferably formed of fabric or other soft goods and/or padding such as foam or batting. The mattress pad 80 is generally sized and shaped similarly to the mattress platform 10 in its expanded configuration and comprises a generally elongate opening 84 along one side thereof for receiving the mattress platform 10 therein. Generally, the elongate opening 84 provides access to a pocket or rectangular-shaped chamber defined within the mattress pad such that the mattress platform 10 can fit therein and provide structural support to the mattress assembly while the pad 80 provides softness and comfort. An additional fabric layer can be provided to cover the mattress pad 80 and a closure mechanism or zipper 90 can substantially secure the mattress platform 10 in place within the mattress pad 80. Preferably, the with mattress platform 10 fitted and secured within the mattress pad 80, the mattress assembly can be positioned in either of the collapsed or expanded configurations and the mattress pad 80 generally conforms to the configuration of the mattress platform 10. Alternatively, the mattress platform 10 is removed from the mattress pad 80 to collapse or expand the mattress assembly. In alternate embodiments, the mattress pad 80 is integrally attached to the mattress platform 10 to form a unitary mattress assembly.

Figure 10:
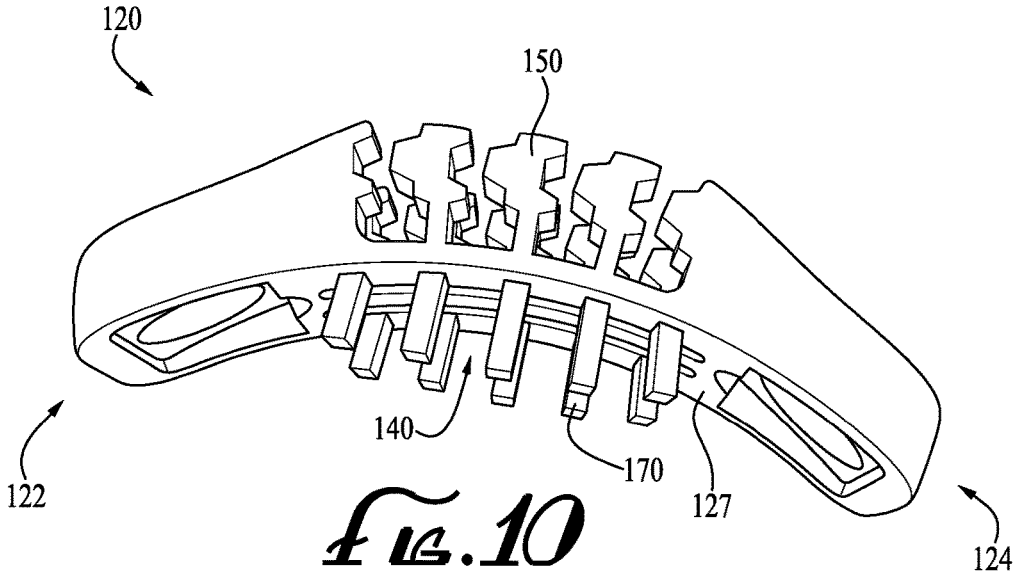
FIG. 10 is a side perspective view of a hinge mechanism according to another example embodiment of the present invention, the hinge mechanism being in a relaxed or unlocked/disengaged configuration.
Figure 11:
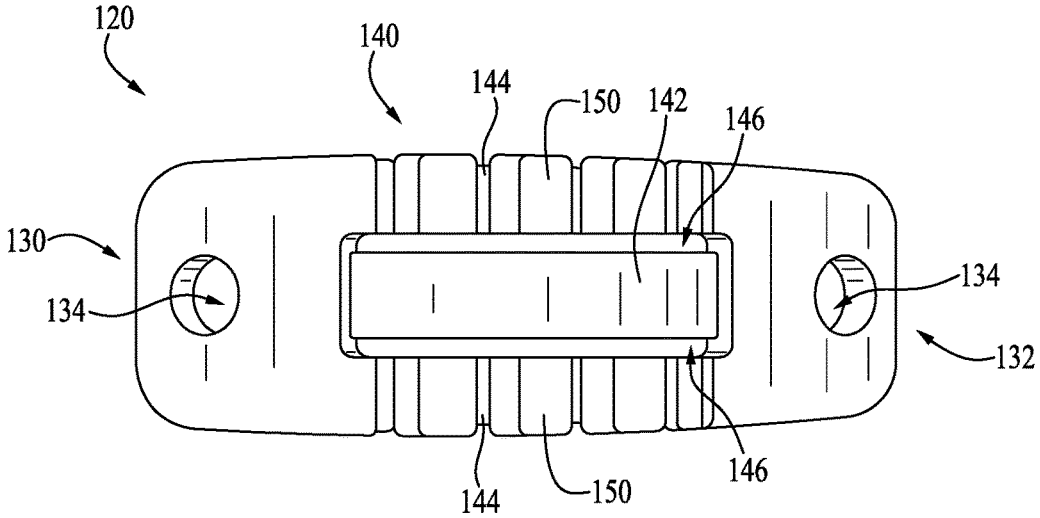
FIG. 11 is a top view of the hinge mechanism of FIG. 10.

FIGS. 10-13 show a hinge 120 according to another example embodiment of the present invention. Generally, the hinge 120 is shaped similarly to the hinge 20 as described above, which comprises first and second mounting portions 130, 132, a pair of outer flexible members 140 and an intermediate inner flexible member 142 joining the first and second mounting portions 130, 132 together, and a plurality of teeth 150 extending from at least one of the flexible members 140 for restricting relative pivotal motion therebetween beyond an expanded limit point in a first direction but permitting pivotal motion therebetween in a second direction. FIG. 10 shows the hinge in a generally relaxed state. The teeth 150 extend generally transversely and outwardly away from the flexible members 140 in a direction generally opposite a bottom or mounting side or surface 127 of the hinge 120. Thus, the one-directional pivotal motion limiting action of the hinge 120 is generally configured to be substantially opposite the hinge 20, for example wherein the hinge 120 prevents pivotal motion beyond the limit point in the first direction (see arrow, FIG. 12) and allows pivotal motion in the second direction (see arrow, FIG. 13).

In the depicted embodiment, the first and second mounting portions 130, 132 each comprise one opening 134 for receiving a fastener, and the bottom surface 127 adjacent the openings 134 comprise a recess formed therein. The interengaging portions of the teeth 150 and portions of the first and second mounting portions 130, 132 are preferably similarly configured to the teeth 50 of the hinge 20. For example, the outer flexible members 144 comprise three teeth 150 extending therefrom, which each comprise a rib 154 extending from one side and a channel or recess 156 formed on another side that is generally opposite the rib 154. Preferably, as similarly described above, the first mounting portion 130 comprises a recessed channel 160 for cooperatively engaging with the rib 154 of one of the teeth 150 and the second mounting portion 132 comprises a rib 162 for cooperatively interengaging with the recess 156 of one of the teeth 150.

Figure 12:
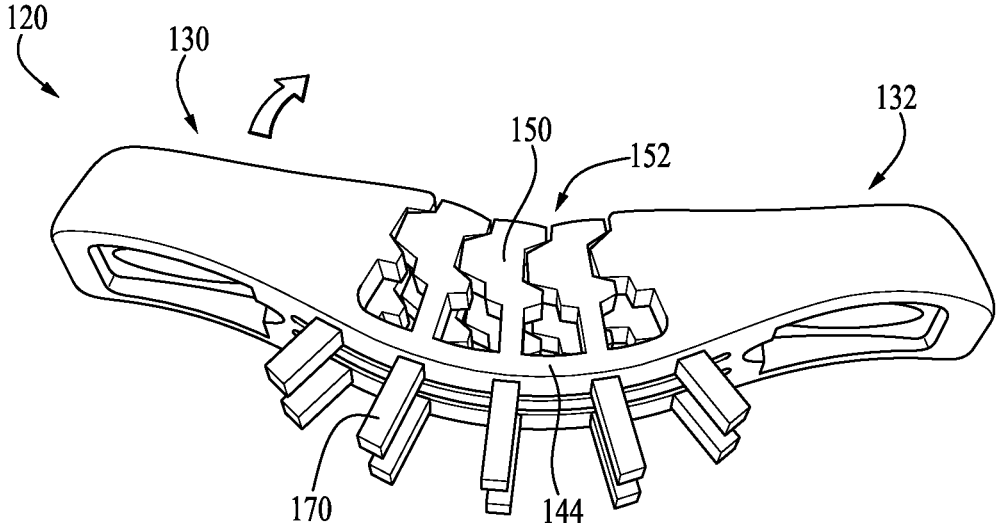
FIG. 12 is a side perspective view of the hinge mechanism of FIG. 10, showing the hinge mechanism in a substantially rigid or locked/engaged configuration.
Figure 13:
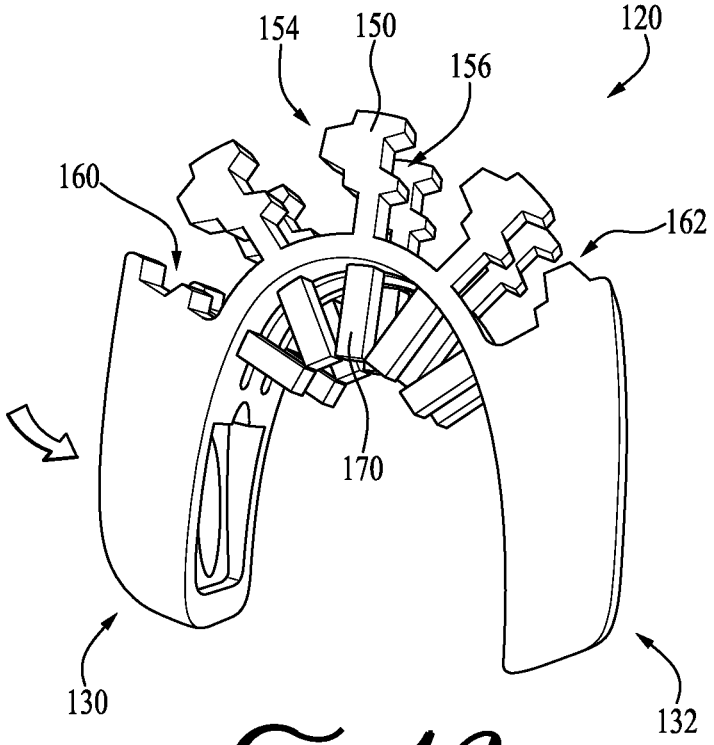
FIG. 13 is a side perspective view of the hinge mechanism of FIG. 10, showing the hinge mechanism in a substantially flexed configuration.

Preferably, the bottom side 127 comprises a plurality of generally elongate fingers or protrusions 170 extending therefrom for preventing the hinge 120 from over-bending in the second direction. For example, as shown in FIG. 12, the protrusions 170 are generally spaced apart along the length of the outer flexible members 144. When the hinge 120 is pivoted in the second direction, the protrusions 170 begin to move towards each other such that at a second or collapsed limit position the protrusions 170 contact each other and prevent further pivotal motion thereof in the second direction (see FIG. 13). In the depicted embodiment, the protrusions 170 are rectangular prismatic or box-shaped in cross section although other shapes (circular, oval, triangular, polygonal, etc.), lengths, etc. may be provided as desired. In one example form, the hinge 120 has a pivotal range of about 180°-200° such that the first and second mounting portions 130, 132 are generally positioned along a substantially similar horizontal plane when the teeth 150 are cooperatively interengaged together and generally positioned along a pair of laterally offset planes when the protrusions 170 are engaged with each other. Optionally, the teeth 150 and the protrusions 170 can be sized, shaped, formed, and otherwise configured to provide a desired pivotal range.

In example embodiments, the hinges 20, 120 are formed from a thermoplastic material, and are manufactured by injection molding such that the portions (e.g., first and second mounting portions, flexible members, teeth) thereof are integrally connected to each other. Optionally, one or more portions of the hinges 20, 120 can be separable or separately formed for assembly together to form the hinge.

In additional example embodiments, the interengagement features 152 of the teeth and the recess and rib of the first and second mounting portions can comprise one or more additional features to provide for removably coupling therebetween. For example, protrusions can be formed on each of the ribs and recesses can be formed within each of the channels such that the teeth and the first and second mounting portions removably couple together to maintain a particular position relative to each other (e.g., the teeth and mounting portions coupling together to generally maintain the panels in the expanded configuration.

In yet another example embodiment, the present invention relates to a method for restricting the pivotal movement of a first panel or member relative to a second panel or member. The method generally includes providing a hinge member, the hinge member comprising first and second mounting portions joined together by at least one flexible member. The first and second mounting portions preferably comprise a top side and bottom side. The flexible member preferably includes at least one rib extending transversely therefrom for interengaging with portions of the first and second mounting portions. The bottom side of one of the first and second mounting portions is coupled to one of the first and second members, and the bottom side of the other of the first and second mounting portions is coupled to the other of the first and second members. The first and second members are thereby pivotally coupled to each other for rotational movement between an expanded configuration, for example in a first horizontal plane, and a collapsed position. Pivoting the first member relative to the second member in a first direction allows the at least one flexible member to flex such that the first member is generally positioned adjacent the second member in a second plane that is generally parallel and offset from the first plane. Pivotal movement of the first member in a second direction opposite the first direction is restricted at a limit point by the engagement of the at least one tab and contact portions of the first and second mounting portions.

In yet another example embodiment, the hinges 20, 120 of the present invention can be used with various other applications beyond mattress panels for child sleeping and containment devices. For example, the one-directional pivotal movement provided by the hinges 20, 120 may be used for doors, bi-fold closet doors, cabinet doors or drawers, electronic doors, furniture, or other structures or equipment where it is desired that at least one member pivot relative to another member within a range of motion, but be restricted from pivoting beyond a limit point at one or both ends of the range of motion. The hinges can be sized, shaped, and configured to provide a desired range of pivotal motion and structural load-bearing capacity.

Various changes and modifications to the mattress structure and/or hinge, beyond those explicitly mentioned herein, are contemplated as being within the scope of the present invention. Moreover, the particular configurations, suggested materials of construction, and objectives described herein are merely exemplary and are in no way limiting. While the invention has been described with reference to preferred and example embodiments, it will be understood by those skilled in the art that a variety of modifications, additions and deletions are within the scope of the invention, as defined by the following claims.

What is claimed is:

1. A hinged panel assembly comprising:
- a first panel;
- a second panel; and
- at least one hinge pivotally coupling the first panel and the second panel to allow relative pivotal motion therebetween, said hinge comprising:
  - a first mounting portion for attachment to the first panel;
  - a second mounting portion opposite the first mounting portion for attachment to the second panel;
  - at least three generally parallel flexible members extending between the first and second mounting portions; and
- wherein the at least three generally parallel flexible members comprise first and second outer members and an intermediate inner member, and wherein the first and second outer members each comprise at least one tooth extending therefrom to define a generally parallel spaced-apart pair of arrays of teeth, which define a limit beyond which the pivotal motion of the panels is restricted.

2. The hinged panel assembly of claim 1, wherein the first and second panels are generally co-planar at the limit beyond which pivotal motion of the panels is restricted.

3. The hinged panel assembly of claim 1, wherein the first and second mounting portions, the three flexible members, and the arrays of teeth are integrally formed as a unitary component.

4. The hinged panel assembly of claim 1, wherein the arrays of teeth define an arched structure at the limit beyond which pivotal motion is restricted.

5. The hinged panel assembly of claim 4, wherein the first mounting portion comprises a recessed portion for receiving a rib extending from the at least one tooth and wherein the second mounting portion comprises a rib for interengaging a recessed portion of the tooth.

6. The hinged panel assembly of claim 1, wherein the at least one tooth comprises interengagement features for cooperatively engaging portions of the first and second mounting portions.

7. The hinged panel assembly of claim 1, wherein the relative pivotal motion between the first and second panels is constrained within a range of motion between a collapsed configuration wherein the first and second panels are positioned in two generally laterally offset parallel planes, and an expanded configuration wherein the first panel is generally coplanar with the second panel.

8. A hinged panel assembly comprising:

a first panel;

a second panel; and at least one hinge pivotally coupling the first panel and the second panel to allow relative pivotal motion therebetween, said hinge comprising a first mounting portion for attachment to the first panel;

a second mounting portion opposite the first mounting portion for attachment to the second panel;

at least one flexible member extending between the first and second mounting portions; and at least one tooth extending from the at least one flexible member to define a limit beyond which the pivotal motion of the panels is restricted;

wherein the at least one tooth comprises a plurality of teeth adjacent one another and forming at least one series of teeth between the first and second mounting portions, whereby abutment of the first and second mounting portions and the series of teeth defines the limit beyond which pivotal motion is restricted.

9. The hinged panel assembly of claim 8, wherein the relative pivotal motion between the first and second panels is constrained within a range of motion between a collapsed configuration wherein the first and second panels are positioned in two generally laterally offset parallel planes, and an expanded configuration wherein the first panel is generally coplanar with the second panel.

10. A method for controlling pivotal movement of a first member relative to a second member comprising:

providing at least one hinge between the first member and the second member;

pivoting the first member relative to the second member into a collapsed configuration by disengagement of a series of interengagement members of the at least one hinge; and pivoting the first member relative to the second member into an expanded configuration by engagement of the series of interengagement members of the at least one hinge into abutment with one another to restrict pivotal motion beyond the expanded configuration.

11. A hinged panel assembly comprising:

a first panel;

a second panel; and at least one hinge pivotally coupling the first panel and the second panel to allow relative pivotal motion therebetween, said hinge comprising:

a first mounting portion for attachment to the first panel;

a second mounting portion opposite the first mounting portion for attachment to the second panel;

at least one flexible member extending between the first and second mounting portions; and at least one tooth extending from the at least one flexible member to define a limit beyond which the pivotal motion of the panels is restricted wherein the relative pivotal motion between the first and second panels is constrained within a range of motion between a collapsed configuration wherein the first and second panels are positioned in two generally laterally offset parallel planes, and an expanded configuration wherein the first panel is generally coplanar with the second panel.

* * * * *